United States Patent [19]

Hicks, Jr.

[11] 4,073,708

[45] Feb. 14, 1978

[54] APPARATUS AND METHOD FOR REGENERATION OF CHROMOSULFURIC ACID ETCHANTS

[75] Inventor: Harry Clark Hicks, Jr., Puyallup, Wash.

[73] Assignee: The Boeing Company, Seattle, Wash.

[21] Appl. No.: 697,600

[22] Filed: June 18, 1976

[51] Int. Cl.[2] ..... C25C 1/12; C25F 3/02; C25C 7/04; C25C 7/06

[52] U.S. Cl. ..... 204/106; 204/129.1; 204/234; 204/252; 156/642; 156/666

[58] Field of Search ..... 204/129.1, 252, 234, 204/97, 106; 156/19, 642, 666

[56] References Cited

U.S. PATENT DOCUMENTS

| | | | |
|---|---|---|---|
| 3,406,108 | 10/1968 | Radimer et al. | 204/234 X |
| 3,615,957 | 10/1971 | Konstantouros | 204/129.1 X |
| 3,634,213 | 1/1972 | Coates | 204/252 X |
| 3,788,915 | 1/1974 | Gulla | 204/129.1 X |

*Primary Examiner*—John H. Mack
*Assistant Examiner*—D. R. Valentine
*Attorney, Agent, or Firm*—Morris A. Case; Bernard A. Donahue

[57] ABSTRACT

A chromic-sulfuric etching solution for copper is regenerated in an etching container with a permeable diaphragm dividing the container into an etching chamber and a sulfuric acid containing chamber. Electric current passes between an anode electrode located in the etchant chamber and a cathode electrode located in the sulfuric acid chamber to regenerate the etchant in the anode containing chamber and to deposit copper on the cathode.

6 Claims, 3 Drawing Figures

APPARATUS AND METHOD FOR REGENERATION OF CHROMOSULFURIC ACID ETCHANTS

BACKGROUND OF THE INVENTION

An aqueous solution of sulfuric acid and a hexavalent chromium ion containing compound is often used as an etchant for removal of metal. This etchant is especially useful in dissolving copper from copper clad laminates in forming electronic printed circuit boards. During the etching process, the hexavalent chromium is converted to trivalent chromium and the dissolved copper forms as a copper sulfate in the etchant. With continued use, the rate of copper removal is slowed due to the increased concentration of the copper in the solution and the reduction of the hexavalent chromium until eventually the etchant must be replaced. The spent etchant presents a disposal problem due to the toxicity of the copper and the chromium. In U.S. Pat. No. 3,615,957 to Konstantouros, a chromosulfuric etching solution for metallic copper is regenerated in a different container from the etching container by use of an electrolytic cell separated by a diaphragm. Copper sulfate is precipitated out of the used etchant, dissolved in water and placed in a cathode space in a cell. The spent etchant is then placed in the anode space, an electric current passed between the electrodes to regenerate the etchant in the anode space and to deposit the copper on the cathode. It is also known to regenerate an aluminum etching chromic-sulfuric etchant in an electrolytic cell where an anode is immersed in the etchant container and a cathode is immersed in sulfuric acid. The dissolved aluminum is precipitated out of the etchant in the form of an aluminum sulfate and the etchant is regenerated. It was discovered that a chromic-sulfuric etchant for copper may be continuously regenerated while in the etchant container, and the dissolved copper may be continuously deposited on a cathode in an electrolytic cell having a diaphragm separating the anode immersed in the etchant and the cathode immersed in sulfuric acid.

SUMMARY OF THE INVENTION

A container for etching a copper or copper containing article by immersing the article in a chromo-sulfuric etchant acts as an anode chamber for electrolytic regeneration of the etchant. A cathode chamber filled with an aqueous solution of an alkali metal sulfate or with sulfuric acid is in communication with the anode chamber through a permeable membrane. When electric current is passed between electrodes located in the two chambers, the etchant is regenerated and the copper dissolved by the etching process is deposited on the cathode electrode.

It is an object of this invention to provide an apparatus for copper etching and for regenerating the etchant simultaneously in the same container.

It is not yet another object to provide a method to continuously etch copper, to continuously regenerate the etchant and to recover dissolved copper.

It is still another object to continuously maintain copper etch rate during the etching.

DETAILED DESCRIPTION

Figure 1:
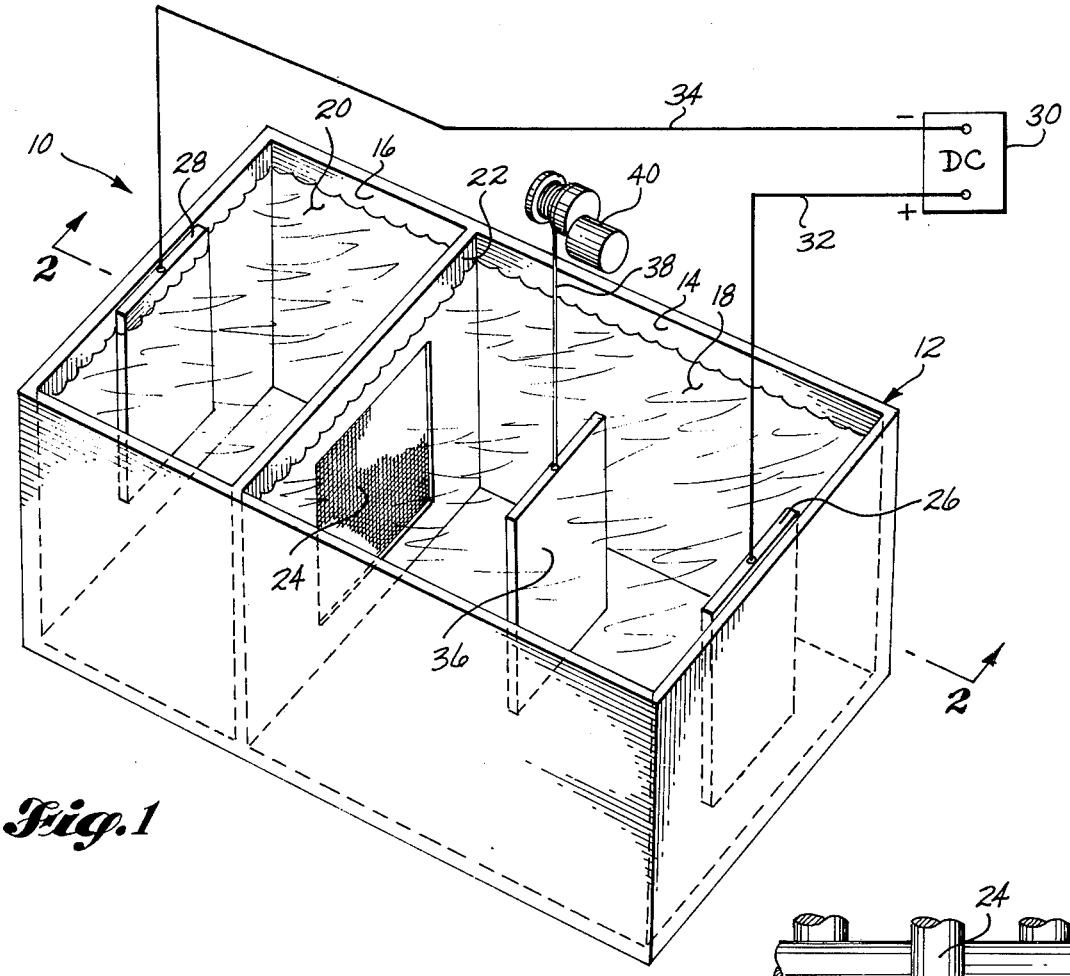
FIG. 1 shows a perspective view of the apparatus of this invention.
Figure 2:
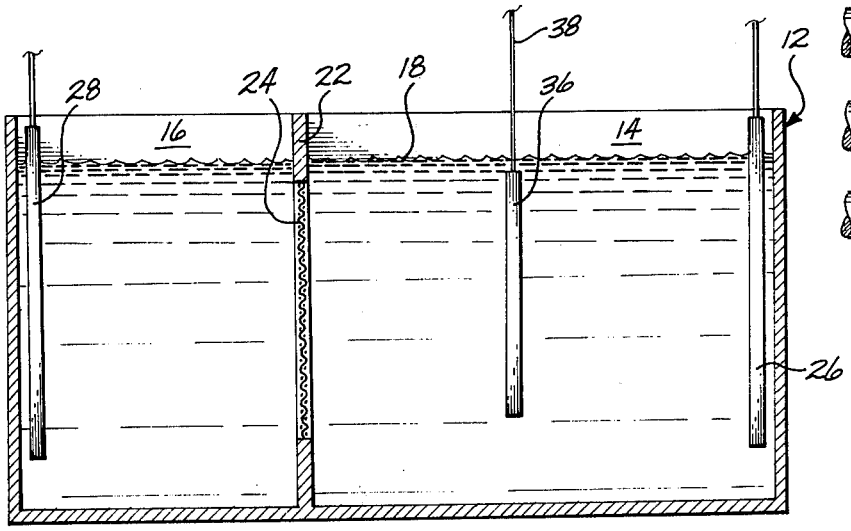
FIG. 2 is a section taken along lines 2—2 of FIG. 1.
Figure 3:
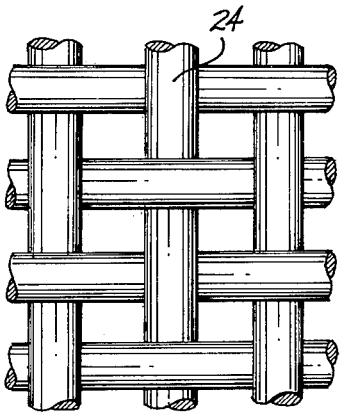
FIG. 3 shows a plan view of the permeable membrane of this invention.

The apparatus 10 of this invention has a tank 12 which is divided into compartments 14 and 16. Compartment 14 contains an aqueous etching solution 18 of a hexavalent chromic oxide-sulfuric acid. The hexavalent chromic acid is obtained from an alkali metal dichromate or from chromic acid, but preferably from sodium dichromate. Compartment 16 contains an aqueous solution 20 of sulfuric acid or of an alkali metal sulfate. The tank is divided into compartments by a barrier 22 which holds a permeable membrane or diaphragm 24 which communicates between the two compartments. This ion-selective member preferably is of polyester or perfluorosulfonic acid; however, it is not desired to limit it to those materials as any material resistant to the chemicals involved may be used. The diaphragm preferably is of a non-woven spun-bonded fabric having interstices to impart permeability to chromium ions of from about 0.02 to about 17.4 grams per square foot per hour when a voltage is impressed across the diaphragm. An anodic electrode 26 is placed in compartment or chamber 14 which contains the etchant, and a cathodic electrode 28 is located in compartment 16 which contains the aqueous solution of sulfuric acid. A direct current power supply 30 impresses a voltage to impart a D.C. current between the electrodes through conductors 32 and 34. A copper or copper containing article such as a circuit board 36 is inserted by use of cable 38, which is controlled by a hoist 40 which is supported overhead by a means not shown.

In operation, the circuit board is lowered into the etchant 18 for a period sufficient to remove the desired amount of copper. As the copper is dissolved and goes into the solution, the following chemical reaction is taking place:

$$3Cu + 6H_2SO_4 + 2CrO_3 \rightarrow 3CuSO_4 + Cr_2(SO_4)_3 + 6H_2O$$

The etchant may be regenerated after the circuit board has been removed or regeneration may be performed at the same time etching is taking place. It is preferred, however, to etch and regenerate at one and the same time as this makes it possible to maintain a nearly constant etching rate with a resultant better control of the etching. In either condition, the etching and the regeneration preferably take place in the same container. To regenerate, a direct current is passed through the electrodes and the following reactions take place:

$$Cr_2(SO_4)_3 + 6H_2O \rightarrow 2CrO_3 + 3H_2SO_4 + 3H_2\uparrow$$

$$2CuSO_4 + 2H_2O \rightarrow 2Cu + 2H_2SO_4 + O_2\uparrow$$

During regeneration, the tri-valent chromic ion is regenerated back to the hexavalent state, the sulfuric acid is reformed and copper dissolved in the anodic chamber 14 passes through the membrane and is deposited on the cathodic electrode 28. it is preferred to use a current density across the diaphragm of from about 110 to 150 amperes per square foot of diaphragm area.

Etching of copper in the etchant, recovery of the dissolved copper by deposition on the cathode and regeneration of the etchant was simultaneously accomplished in a 7 day test, the results of which are shown in TABLE I. The etchant or anode chamber contained about 19% sulfuric acid, 10% chromium oxide and 71% water by weight. The cathode chamber contained about 27% sulfuric acid and 73% water by weight for the first 6 days. On the seventh day, the cathode chamber was emptied and then filled with a saturated aqueous solution of potassium sulfate. A diaphragm of perfluorosulfonic acid (Du Pont Nafion 36-3080) was used between the two chambers. Each day a copper panel was immersed in the anode chamber and the current was turned on during the hours shown. On the third day, however, the copper panel was not immersed, but the current was turned on.

TABLE I

| TIME | AMPERES | DISSOLVED COPPER (Cum-gms) | ETCH RATE (gm/hr) | $H_2SO_4$ ANODE (gm/l) | $CrO_3$ ANODE (gm/l) | DEPOSITED COPPER CATHODE (gm) |
|---|---|---|---|---|---|---|
| 10:00 AM | 3 | 0 | | 256 | 114 | 0 |
| 11:17 | 3 | 9.4 | | | 116 | |
| 3:07 PM | 3 | 25.1 | 5.3 | 253 | 115 | |
| 8:45 AM | 3 | 25.1 | | 254 | 112 | 0 |
| 2:00 | 3 | 44.9 | 3.4 | 271 | 114 | |
| 3:15 PM | 3.5 | | | 265 | 112 | |
| 1:45 PM | 3.8 | | | 280 | 112 | |
| 3:00 | | | | 277 | 117 | .2 |
| 10:40 AM | 3.6 | 44.9 | | | | |
| 2:40 PM | 3.75 | 90.3 | 11.4 | 273 | 115 | .7 |
| 8:09 AM | 10 | 90.3 | | 267 | 111 | |
| 9:30 | 13.5 | | | | 112 | |
| 10:39 | 13.5 | | | 265 | 112 | |
| 12:15 | 13.5 | | | 268 | 112 | |
| 2:49 | 13.0 | 184.3 | 14.1 | | | 2.5 |
| 3:30 PM | | | | 276 | 107 | |
| 10:50 AM | 12.3 | 184.3 | | | 107 | |
| 1:50 | 13.0 | 217.7 | | | 107 | |
| 2:50 PM | 13.0 | | | 273 | 111 | |
| 9:25 AM | 15.0 | | | 271 | 108 | |
| 1:10 | 15.0 | 217.7 | | 277 | 113 | |
| 2:33 | | 232.6 | 14.8 | | 113 | |
| 3:30 PM | | | | | | 4.3 |

The etching of the copper panel, the regeneration of the tri-valent chromium ion back to the hexavalent state and the deposition of the dissolved copper onto the cathode electrode all took place simultaneously in the same container.

What is claimed is:

1. An apparatus having a tank for etching copper in a chromic-sulfuric etchant and for regenerating the etchant and depositing out dissolved copper within the tank, the apparatus comprising: means for dividing an etchant tank into two compartments adapted to contain an aqueous copper etching hexavalent chromic oxide-sulfuric acid etchant in an etching compartment and adapted to contain an aqueous solution consisting essentially of alkali metal sulfate or sulfuric acid in a cathode compartment, a permeable membrane communicating between the two compartments, an anodic electrode located in the etching compartment, an electrode located in the cathode compartment, means for passing an electric current between the electrodes, and means for introducing a copper containing article into the etching compartment to permit simultaneous etching of the article regeneration of the etchant and deposition of copper in the etchant tank.

2. An apparatus as in claim 1 wherein the membrane is selected from material consisting essentially of polyester or perfluorosulfonic acid.

3. An apparatus as in claim 2 wherein the hexavalent chromic oxide comprises sodium dichromate and the aqueous solution in the cathode compartment is sulfuric acid.

4. An apparatus for simultaneously and in the same container etching a copper article, regenerating the etchant and depositing copper dissolved in the etchant comprising: a first compartment having an anodic electrode adapted to be immersed in an etchant of aqueous hexavalent chromic oxide-sulfuric acid, a second compartment having a cathodic electrode adapted to be immersed in an aqueous solution of materials consisting essentially of alkali-metal sulfate or sulfuric acid, a diaphragm communicating between the two compartments, means for introducing a copper article into the etchant compartment, and means for imparting an electric current between the electrodes to regenerate the etchant and to deposit copper on the cathodic electrode at the same time the copper article is being etched in the container.

5. A process for etching copper in hexavalent chromic oxide-sulfuric acid etchant while simultaneously and in the same container regenerating the etchant and depositing out copper dissolved in the etchant, the steps comprising: introducing an anodic electrode into an aqueous hexavalent chromic oxide-sulfuric acid etchant, utilizing a permeable diaphragm as a barrier to contain the etchant, introducing an aqueous solution selected from sulfuric acid or an alkali metal sulfate on an opposite side of the diaphragm, introducing a cathodic electrode in the aqueous solution immersing a copper article in the etchant, and passing an electric current between the electrodes for regenerating the etchant at the anode and for depositing copper on the cathode.

6. A method of etching copper in a chromate-sulfuric etchant and at the same time and in the same container regenerating the etchant while depositing etchant dissolved copper, the steps comprising: dividing a container into two chambers, utilizing a diaphragm over at least part of an area dividing the chambers, introducing an aqueous hexavalent chromic oxide-sulfuric acid etchant and an anodic electrode in one chamber, introducing an aqueous solution selected from materials consisting essentially of an alkali metal sulfate or sulfuric acid and also a cathodic electrode in the second chamber, immersing a copper article in the etchant, and passing an electric current between the electrodes to regenerate the etchant and deposit copper on the cathode.

* * * * *

UNITED STATES PATENT OFFICE

CERTIFICATE OF CORRECTION

Patent No. 4,073,708 Dated February 14, 1978

Inventor(s) HARRY CLARK HICKS, JR.

It is certified that error appears in the above-identified patent and that said Letters Patent are hereby corrected as shown below:

In column 1, and on line 59, the inclusion of the word "not" is in error.

Signed and Sealed this

Thirtieth Day of May 1978

[SEAL]

Attest:

RUTH C. MASON
Attesting Officer

LUTRELLE F. PARKER
Acting Commissioner of Patents and Trademarks